US010648676B2

(12) United States Patent
Lee

(10) Patent No.: US 10,648,676 B2
(45) Date of Patent: May 12, 2020

(54) OVEN

(71) Applicant: Samsung Electronics Co., Ltd, Suwon-si (KR)

(72) Inventor: Dong Ho Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 154 days.

(21) Appl. No.: 15/750,160

(22) PCT Filed: Jul. 26, 2016

(86) PCT No.: PCT/KR2016/008143
§ 371 (c)(1),
(2) Date: Feb. 2, 2018

(87) PCT Pub. No.: WO2017/023004
PCT Pub. Date: Feb. 9, 2017

(65) Prior Publication Data

US 2018/0224130 A1 Aug. 9, 2018

(30) Foreign Application Priority Data

Aug. 4, 2015 (KR) ..... 10-2015-0109842

(51) Int. Cl.
*F24C 15/00* (2006.01)
*F24C 15/04* (2006.01)
(Continued)

(52) U.S. Cl.
CPC ..... *F24C 15/006* (2013.01); *F24C 15/00* (2013.01); *F24C 15/02* (2013.01); *F24C 15/021* (2013.01);
(Continued)

(58) Field of Classification Search
CPC ..... F24C 15/02; F24C 15/34
(Continued)

(56) References Cited

U.S. PATENT DOCUMENTS 3,877,460 A * 4/1975 Lotz ..... F24C 15/04 126/200
4,206,338 A * 6/1980 Katona ..... F24C 15/04 219/740
(Continued)

FOREIGN PATENT DOCUMENTS

CN 101063532 A 10/2007
CN 102188169 A 9/2011
(Continued)

OTHER PUBLICATIONS

Supplementary European Search Report dated Jun. 6, 2018 in connection with European Patent Application No. 16 83 3240.
(Continued)

*Primary Examiner* — Gregory L Huson
*Assistant Examiner* — Nikhil P Mashruwala

(57) ABSTRACT

Disclosed herein is an oven able to reduce the temperature of an upper portion of the front glass through a door duct having an improved flow path structure for some of the air sucked into the inside of the door to reach to the upper portion of the front glass. An oven includes a main body; a cooking room provided inside the main body with an open front; a door, wherein the door includes a front glass installed on a front side; a rear glass installed on a rear side; at least one middle glass arranged between the front glass and the rear glass; a door handle coupled to an upper portion of the front glass; support frames arranged on both sides of the door to fix the front glass, the rear glass, and the middle glass; and a door duct coupled to an upper portion of the support.

20 Claims, 19 Drawing Sheets

(51) Int. Cl.
*F24C 15/02* (2006.01)
*F24C 15/34* (2006.01)
*F24C 15/20* (2006.01)
*F24C 15/32* (2006.01)

(52) U.S. Cl.
CPC ..... *F24C 15/04* (2013.01); *F24C 15/2007* (2013.01); *F24C 15/34* (2013.01); *F24C 15/325* (2013.01)

(58) Field of Classification Search
USPC ..... 126/198, 21 A
See application file for complete search history.

(56) References Cited

U.S. PATENT DOCUMENTS 4,606,324 A * 8/1986 Katona ..... F24C 15/04 126/198
5,387,258 A * 2/1995 Puricelli ..... F24C 15/04 126/198
5,881,710 A * 3/1999 Davis ..... F24C 15/04 126/194
6,561,180 B1 * 5/2003 Austin ..... F24C 15/02 126/190
7,686,009 B2 * 3/2010 Park ..... F24C 15/006 126/190
7,703,451 B2 4/2010 Bang
7,856,973 B2 * 12/2010 Kim ..... F24C 15/006 126/273 R
9,115,903 B2 8/2015 Lim et al.
9,377,204 B2 * 6/2016 Plevacova ..... C03C 3/085
9,784,457 B2 * 10/2017 Oh ..... F24C 15/006
9,907,122 B2 * 2/2018 Himmelein ..... H05B 6/6414
9,913,323 B2 * 3/2018 Houbloss ..... H05B 6/6414
2007/0125760 A1 * 6/2007 Kim ..... F24C 15/04 219/391
2007/0131220 A1 6/2007 Kim et al.
2011/0214661 A1 * 9/2011 Hyun ..... F24C 15/006 126/21 A
2015/0068510 A1 * 3/2015 Lee ..... F24C 15/006 126/198
2016/0033143 A1 * 2/2016 Lee ..... F23M 5/00 126/198
2016/0045038 A1 * 2/2016 Chubb ..... A47F 3/0434 312/116
2016/0209047 A1 * 7/2016 Hildner ..... F24C 15/045

FOREIGN PATENT DOCUMENTS

EP 1909035 A1 4/2008
EP 2363648 A2 9/2011
EP 2921782 A2 9/2015
EP 2980491 A2 2/2016
FR 2934671 A1 2/2010
JP 2002340343 A 11/2002
KR 20-0152112 Y1 7/1999
KR 10-0676138 B1 2/2007
KR 10-0698204 B1 3/2007
KR 10-0786087 B1 12/2007
KR 10-1207301 B1 12/2012

OTHER PUBLICATIONS

Office Action dated Jan. 28, 2019 in connection with Chinese Patent Application No. 201680043750.4, 14 pages.
International Search Report dated Oct. 31, 2016 in connection with International Patent Application No. PCT/KR2016/008143.
Written Opinion of the International Searching Authority dated Oct. 31, 2016 in connection with International Patent Application No. PCT/KR2016/008143.
China National Intellectual Property Administration, "The Second Office Action," Application No. CN201680043750.4, dated Aug. 12, 2019, 14 pages.

* cited by examiner

OVEN

CROSS-REFERENCE TO RELATED APPLICATIONS AND CLAIM OF PRIORITY

The present application claims priority under 35 U.S.C. § 365 and is a 371 National Stage of International Application No. PCT/KR2016/008143 filed Jul. 26, 2016, which claims priority to Korean Patent Application No. 10-2015-0109842 filed Aug. 4, 2015, the disclosures of which are fully incorporated herein by reference into the present disclosure as if fully set forth herein.

TECHNICAL FIELD

The present disclosure relates to an oven able to reduce the temperature of a door by forcing air flowing into the door to be circulated inside the door.

BACKGROUND

Ovens are devices typically equipped with a cooking room, a heating device for applying heat to the cooking room, and a circulation fan for circulating the heat produced by the heating device inside the cooking room to cook food.

The ovens are appliances to cook by sealing up and heating food, and the ovens may be generally classified by their heat sources into electric, gas, and microwave ovens.

The electric oven uses an electric heater as a heat source, and the gas and microwave ovens use heat from gas and frictional heat of water molecules at high frequencies as heat sources, respectively.

The oven commonly includes a main body forming the exterior and having a cooking room formed therein with an open front through which to throw in food to be cooked, and a door installed on the front of the main body to selectively open or close the cooking room.

The door is formed of a plurality of glasses to prevent heat inside the cooking room from leaking out.

The temperature of the door rises due to heat inside the cooking room, so in order to prevent the rise in temperature of the door, the door is equipped with an air sucking port to suck in outside air, which then circulates in air flow paths formed between the plurality of glasses, reducing the air temperature, and is then discharged out of the door.

The front glass among the plurality of glasses constituting the door, which is farthest from the cooking room, remains at the relatively lowest temperature, but the air circulating in the air flow path is discharged to the outside through a discharging port provided in an upper portion of the door in a state of being gathered and mixed at upper portions of the plurality of glasses.

Thus the upper portion of the front glass remains at relatively high temperature as compared with other portions of the front glass.

Since a door handle is mounted in the upper portion of the front glass, which remains at relatively high temperature, the user may feel unpleasant from the high temperature when grabbing the door handle.

SUMMARY

The present disclosure provides an oven able to reduce the temperature of an upper portion of the front glass through a door duct having a flow path structure improved for some of the air sucked into the inside of the door and circulating in air flow paths inside the door, which flow between the front glass and a middle glass, to reach to the upper portion of the front glass.

In accordance with an aspect of the present disclosure, an oven is provided. The oven includes a main body; a cooking room provided inside the main body with an open front; a door provided to open or close the cooking room, wherein the door includes a front glass installed on the front side; a rear glass installed on the rear side; at least one middle glass arranged between the front glass and the rear glass to form a plurality of air flow paths; a door handle coupled to an upper portion of the front glass; support frames arranged on both sides of the door to fix the front glass, the rear glass, and the middle glass; and a door duct coupled to an upper portion of the support frame for guiding an air flow path between the front glass and the middle glass to extend to an upper portion of the front glass.

The middle glass may include a first middle glass arranged on the rear side of the front glass to be adjacent to the front glass and a second middle glass arranged between the first middle glass and the rear glass.

The air flow path may include a first air flow path formed between the front glass and the first middle glass, a second air flow path formed between the first middle glass and the second middle glass, and a third air flow path formed between the second middle glass and the rear glass.

The support frame may have a plurality of support ribs to support the middle glass not to be moved, a coupler coupled with the door duct, and a hinge member to have the door pivotally coupled with the main body.

The door duct may have a first coupling hole to be coupled with the coupler, and the coupler has a second coupling hole corresponding to the first coupling hole.

The door duct may include a first contact portion that is in close contact with an upper portion of the rear side of the front glass, a guide forming a guide path to guide the first air flow path to extend to an upper portion of the front glass, a second contact portion that is in close contact with an upper portion of the rear side of the rear glass, and a plurality of discharging holes through which air inside the door is discharged out of the door in a direction toward the cooking room.

The top of the guide path may be opened, and the guide may be arranged between the front glass and the first middle glass to force some of the air flowing in the first air flow path to be discharged out of the door through the guide path and some of the rest of the air flowing in the first air flow path to be discharged out of the first air flow path through a space between the guide and the first middle glass.

The air discharged through the space between the guide and the first middle glass may be discharged out of the door through the discharging hole along with the air flowing in the second air flow path and the third air flow path.

The door duct may include a first contact portion that is in close contact with an upper portion of the rear side of the front glass, a guide forming a guide path to guide the first air flow path to extend to an upper portion of the front glass, a second contact portion that is in close contact with an upper portion of the rear side of the rear glass, a plurality of first discharging holes provided on the guide, through which air in the guide path is discharged out of the guide path, and a plurality of second discharging holes through which air inside the door is discharged out of the door in a direction toward the cooking room.

One side of the guide may be in close contact with an upper portion of the rear side of the first middle glass and the other side may be coupled to the first contact portion, forcing the air flowing in the first air flow path to pass the guide and be discharged to the outside through the first discharging hole and forcing the air flowing in the second air flow path and the third air flow path to be discharged out of the door through the second discharging hole.

The guide may include a first guide forming a first guide path between the guide and the front glass to guide the first air flow path to extend upward, and a second guide forming a second guide path between the guide and front glass to guide the first guide path to extend to an upper portion of the front glass.

The second guide may protrude from the first contact portion toward the rear glass to open the top of the second guide path while arranged between the front glass and the first middle glass, and one side of the first guide may be in close contact with an upper portion of the rear side of the first middle glass and the other side is coupled to the second guide, and the first discharging hole is formed on the first guide.

The air flowing in the first air flow path may reach the first guide path, some of which is discharged out of the door through the second guide path and some of the rest of which is discharged out of the first guide path through the first discharging hole and discharged out of the door through the second discharging hole along with the air flowing in the second air flow path and the third air flow path.

The guide may be arranged between the front glass and the first middle glass to force some of the air flowing in the first air flow path to pass the guide path and be discharged out of the guide path through the first discharging hole and some of the rest of the air flowing in the first air flow path to be discharged through a space between the guide and the first middle glass.

The air discharged out of the guide path through the first discharging hole and the air discharged through the space between the guide and the first middle glass may be discharged out of the door through the second discharging hole along with the air flowing in the second air flow path and the third air flow path.

In accordance with another aspect of the present disclosure, an oven is provided. The oven includes a main body; a cooking room provided inside the main body with an open front; a door provided to open or close the cooking room, wherein the door includes a front glass installed on the front side; a first middle glass arranged on the rear side of the front glass to form a first air flow path between it and the front glass, a second middle glass arranged on the rear side of the first middle glass to form a second air flow path between it and the first middle glass, a rear glass arranged on the rear side of the second middle glass to form a third air flow path between it and the second middle glass, a door handle coupled to an upper portion of the front side of the front glass, and a door duct arranged on the top of the door to guide the first air flow path to extend to an upper portion of the front glass.

The door duct may include a first contact portion that is in close contact with an upper portion of the rear side of the front glass, a guide forming a guide path to guide the first air flow path to extend to an upper portion of the front glass, a second contact portion that is in close contact with an upper portion of the rear side of the rear glass, and a plurality of discharging holes through which air inside the door is discharged out of the door in a direction toward the cooking room.

The top of the guide path may be opened, and the guide may be arranged between the front glass and the first middle glass to force some of the air flowing in the first air flow path to be discharged out of the door through the guide path and some of the rest of the air flowing in the first air flow path to be discharged out of the first air flow path through a space between the guide and the first middle glass.

The air discharged through the space between the guide and the first middle glass may be discharged out of the door through the discharging hole along with the air flowing in the second air flow path and the third air flow path.

The door duct may include a first contact portion that is in close contact with an upper portion of the rear side of the front glass, a guide forming a guide path to guide the first air flow path to extend to an upper portion of the front glass, a second contact portion that is in close contact with an upper portion of the rear side of the rear glass, a plurality of first discharging holes provided on the guide, through which air in the guide path is discharged out of the guide path, and a plurality of second discharging holes through which air inside the door is discharged out of the door in a direction toward the cooking room.

One side of the guide may be in close contact with an upper portion of the rear side of the first middle glass and the other side may be coupled to the first contact portion, forcing the air flowing in the first air flow path to pass the guide and be discharged to the outside through the first discharging hole and forcing the air flowing in the second air flow path and the third air flow path to be discharged out of the door through the second discharging hole.

The guide may include a first guide forming a first guide path between the guide and the front glass to guide the first air flow path to extend upward, and a second guide forming a second guide path between the guide and front glass to guide the first guide path to extend to an upper portion of the front glass.

The second guide may protrude from the first contact portion toward the rear glass to open the top of the second guide path while arranged between the front glass and the first middle glass, and one side of the first guide may be in close contact with an upper portion of the rear side of the first middle glass and the other side is coupled to the second guide, and the first discharging hole is formed on the first guide.

The air flowing in the first air flow path may reach the first guide path, some of which is discharged out of the door through the second guide path and some of the rest of which is discharged out of the first guide path through the first discharging hole and discharged out of the door through the second discharging hole along with the air flowing in the second air flow path and the third air flow path.

The guide may be arranged between the front glass and the first middle glass to force some of the air flowing in the first air flow path to pass the guide path and be discharged out of the guide path through the first discharging hole and some of the rest of the air flowing in the first air flow path to be discharged through a space between the guide and the first middle glass.

The air discharged out of the guide path through the first discharging hole and the air discharged through the space between the guide and the first middle glass may be discharged out of the door through the second discharging hole along with the air flowing in the second air flow path and the third air flow path.

According to embodiments of the present disclosure, temperature of an upper portion of a front glass on which a door handle is mounted is reduced by means of flow paths using the shape of a door duct to secure reliability of the product.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 19, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments of the present disclosure will now be described in detail with reference to accompanying drawings.

In the following description, the term 'front' refers to a direction toward the front with respect to a main body of an oven, and 'back' refers to a direction toward the back with respect to the main body of the oven.

Moreover, the term 'upper portion' refers to a portion directed to the top with respect to the main body of the oven and 'lower portion' refers to a portion directed to the bottom with respect to the main body of the oven.

Figure 1:
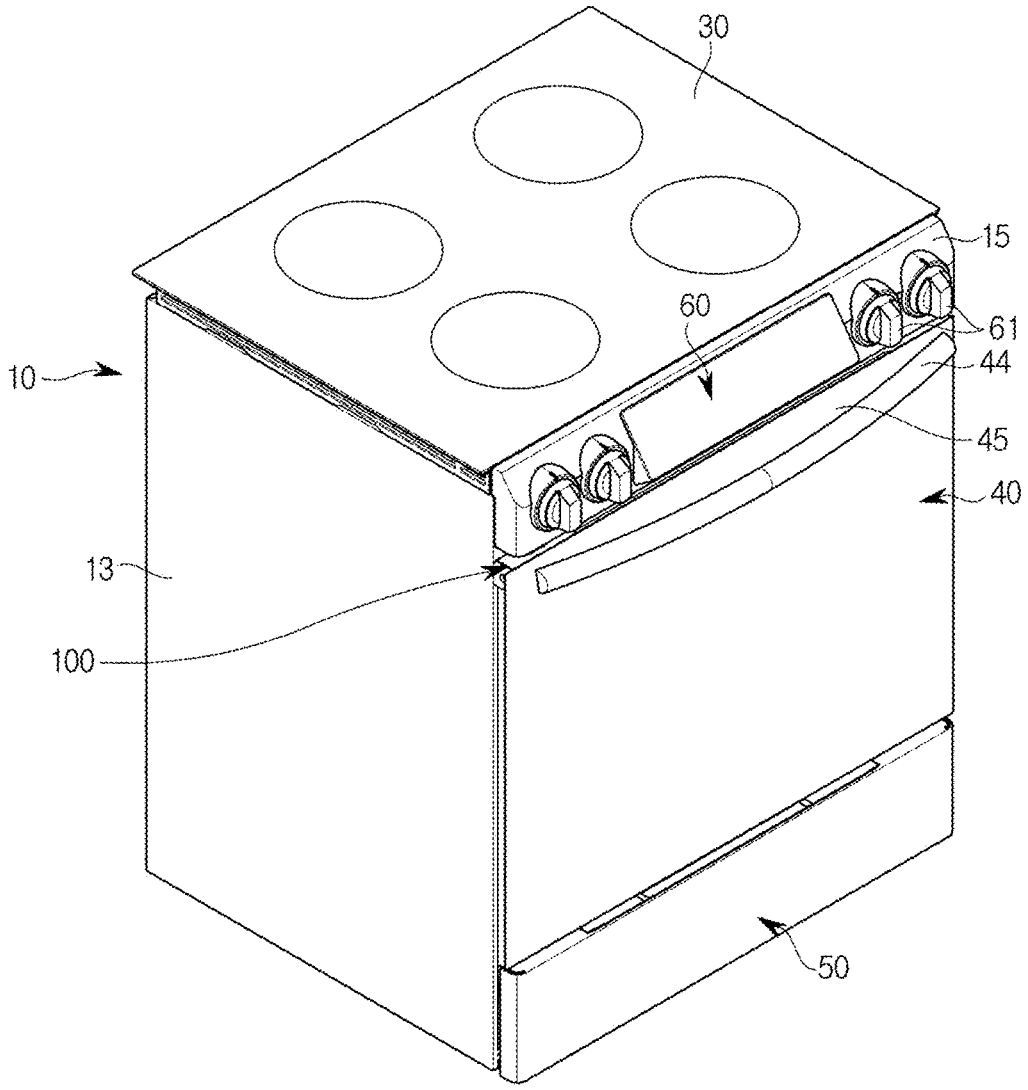
FIG. 1 is a perspective view of an oven, according to an embodiment of the present disclosure.
Figure 2:
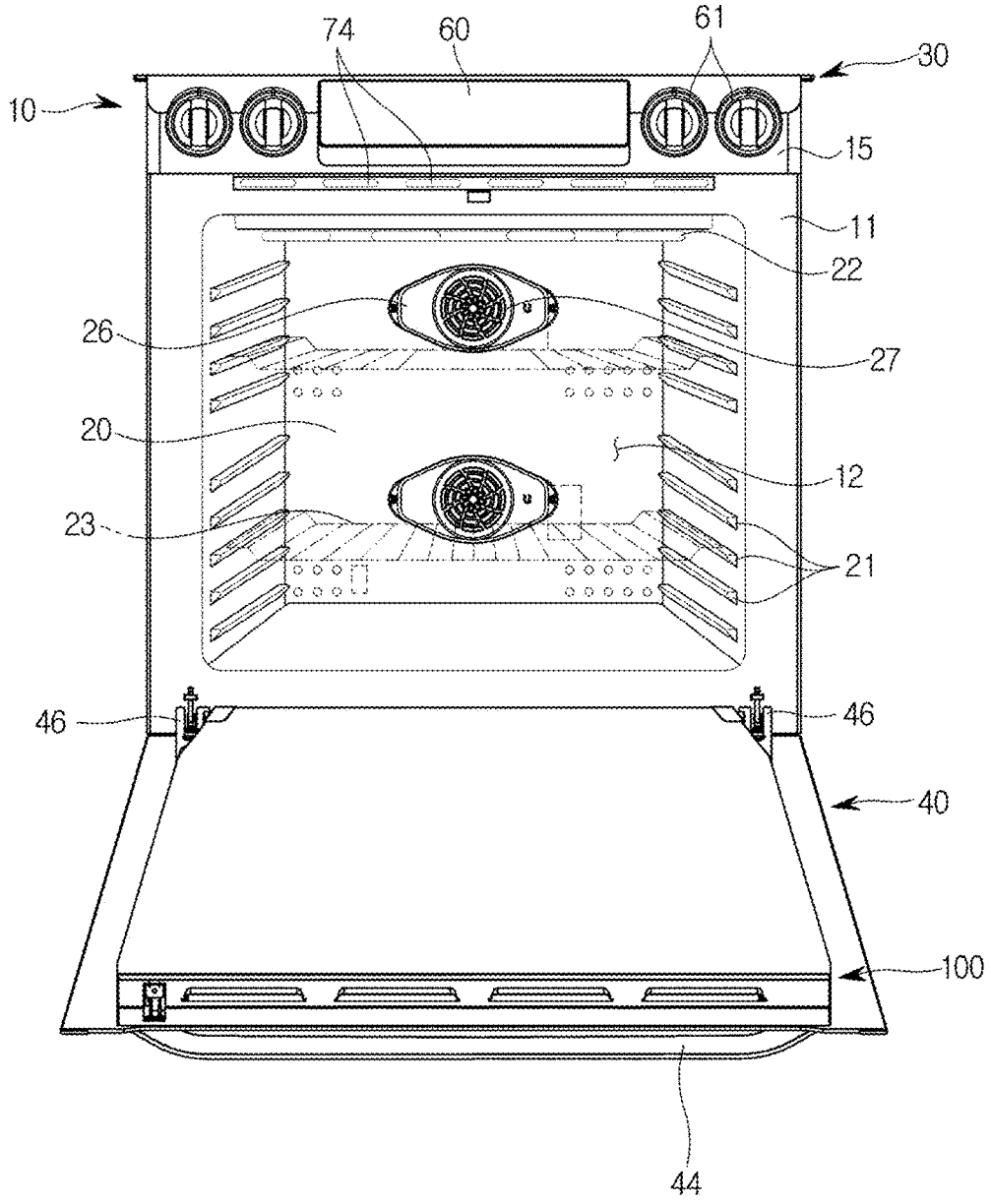
FIG. 2 is a view of an oven with a door open, according to an embodiment of the present disclosure.
Figure 3:
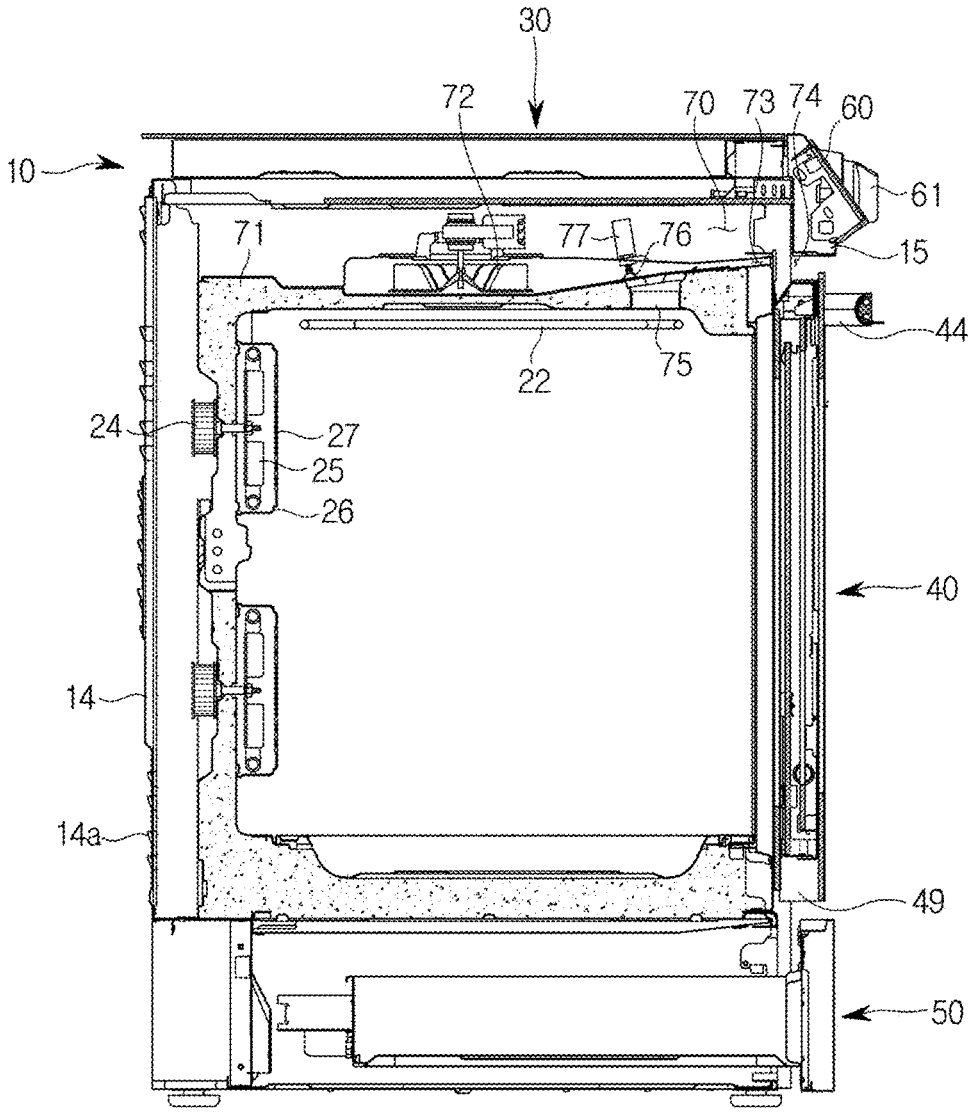
FIG. 3 is a side cross-sectional view of an oven, according to an embodiment of the present disclosure.

As shown in FIGS. 1 to 3, an oven includes a main body 10 forming the exterior, a cooking room 20 provided inside the main body 10 with the front open, a cooktop 30 provided on top of the oven to place a container with a material to be cooked thereon and heat it, and a door 40 provided on the front of the main body 10 to open or close the cooking room 20.

The main body 10 may include a front panel 11 forming the front of the main body 10, side panels 13 forming the sides of the main body 10, and a rear panel 14 forming the back of the main body 10.

The front panel 11 has an opening 12 formed thereon to open the front of the cooking room 20 arranged inside the main body 10.

A machine room cover 15 may be provided in upper front portion of the front panel 11 to cover the front of a machine room 70, which will be described later, and a display module 60, which will be described later, may be mounted on the machine room cover 15.

Through holes **14*a* are provided on the rear panel 14 to suck air into the machine room 70, and the outside air sucked into the machine room 70 through the through holes 14*a* moves around in the machine room 70** to cool electric parts.

The cooking room 20 is provided to have a box form inside the main body 10, and the front of the cooking room 20 is opened through the opening 12 of the front panel 11 to put in or pull out food.

A plurality of supporters 21 may be provided on both side walls inside the cooking room 20, and racks 23 to place food thereon may be mounted on the plurality of supporters 21.

A divider (not shown) may be detachably mounted on the plurality of supporters 21 to divide the cooking room 20 into multiple ones.

The multiple cooking rooms divided by the divider from the cooking room 20 are not necessarily the same but may be different in size, and the divider may be formed of an insulation material to insulate each cooking room 20.

This may allow the plurality of divided rooms of the cooking room 20 to be variously used according to the user's intention.

A heater 22 may be provided in the cooking room 20 to heat the food, and the heater 22 may be an electric heater including an electric resistor.

The heater 22 is not limited to the electric heater, but may be a gas heater that produces heat by burning gas.

Accordingly, the oven may include an electric oven and a gas oven.

A circulation fan 25 to evenly heat the food by circulating air in the cooking room 20 and a circulation motor 24 to drive the circulation fan 25 may be provided in the back of the cooking room 20.

A fan cover 26 may be provided to cover the circulation fan 25 in front of the circulation fan 25, and there are through holes 27 on the fan cover 26 to allow airflow.

The open front of the cooking room 20 may be opened or closed by the door 40, and the door 40 may be hinged on a lower portion of the main body 10 to pivot against the main body 10.

A door handle 44 may be provided in an upper front portion of the door 40 for the user to grab it to open or close the cooking room 20 with the door 40.

Detailed configuration of the door 40 will now be described.

A storage room 50 is provided underneath the cooking room 20 for storing cooking utensils therein.

The storage room 50 may slide forward to be pulled out from the main body 10 or slide backward to be pushed into the main body 10.

The display module 60 for displaying various kinds of operation information of the oven and allowing the user to input an operation command may be mounted on the machine room cover 15 arranged on the upper front portion of the front panel 11, and a manipulation unit 61 may further be provided on the machine room cover 15 to additionally operate the oven.

The oven has the machine room 70 that contains electric parts to control operation of various components including the display module 60.

The machine room 70 may be placed above the cooking room 20, and there may be an insulation member 71 arranged between the machine room 70 and the cooking room 20 to insulate the machine room 70 and the cooking room 20 to prevent heat in the cooking room 20 from being transferred to the machine room 70.

The insulation member 71 may be provided between the machine room 70 and furthermore provided to cover the outside of the cooking room 20 on the whole to prevent the heat in the cooking room 20 from being transferred to the outside of the oven.

Since the temperature inside the machine room 70 may rise due to heat from the various electric parts, a cooling structure is provided in the oven to cool the machine room 70 by forcing air to circulate around the machine room 70.

The cooling structure of the oven may include a cooling fan unit 72 for moving air and a cooling path 73 for discharging the air sucked in by the cooling fan unit 72 forward from the oven.

The air outside the oven may be sucked into the machine room 70 through the through holes 14*a* formed on the rear panel 14, and the air sucked into the machine room 70 may be moved around inside the machine room 70 to cool off the electric parts and discharged forward from the oven through a discharging port 74 along the cooling path 73.

Some air in the cooking room 20 may be sucked into the cooling path 73 through a discharging path 75 and then be discharged forward from the oven.

A bypass hole 76 may further be formed to move some of the air flowing to the discharging port 74 from the cooling path 73 to the discharging path 75, and the bypass hole 76 is opened or closed by an open/close device 77.

As the bypass hole 76 is opened or closed by the open/close device 77, the inflow of some of the air moving to the discharging port 74 from the cooling path 73 to be moved into the discharging path 75 is controlled, and accordingly, an amount of air to be discharged to the discharging path 75 from the cooking room 20 may be controlled.

Next, a structure of the door 40 to open/close the cooking room 20 will be described in detail.

Figure 4:
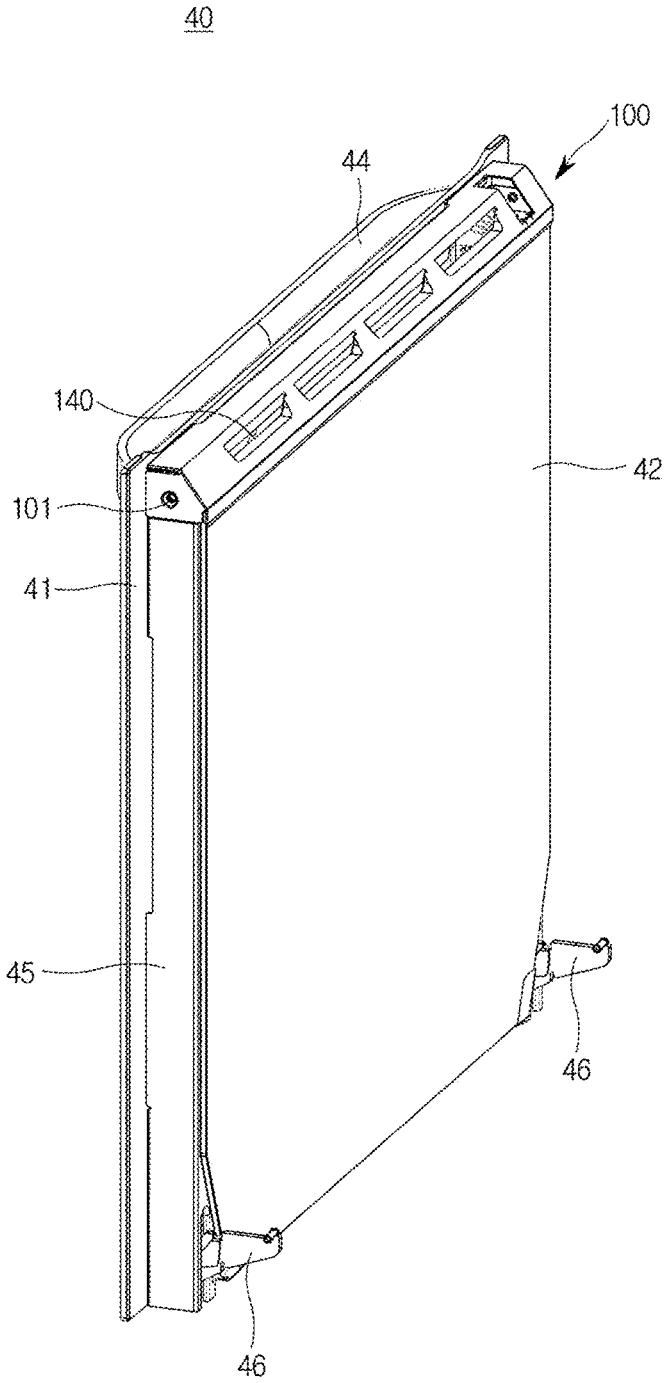
FIG. 4 is a perspective view of a door, according to an embodiment of the present disclosure.
Figure 5:
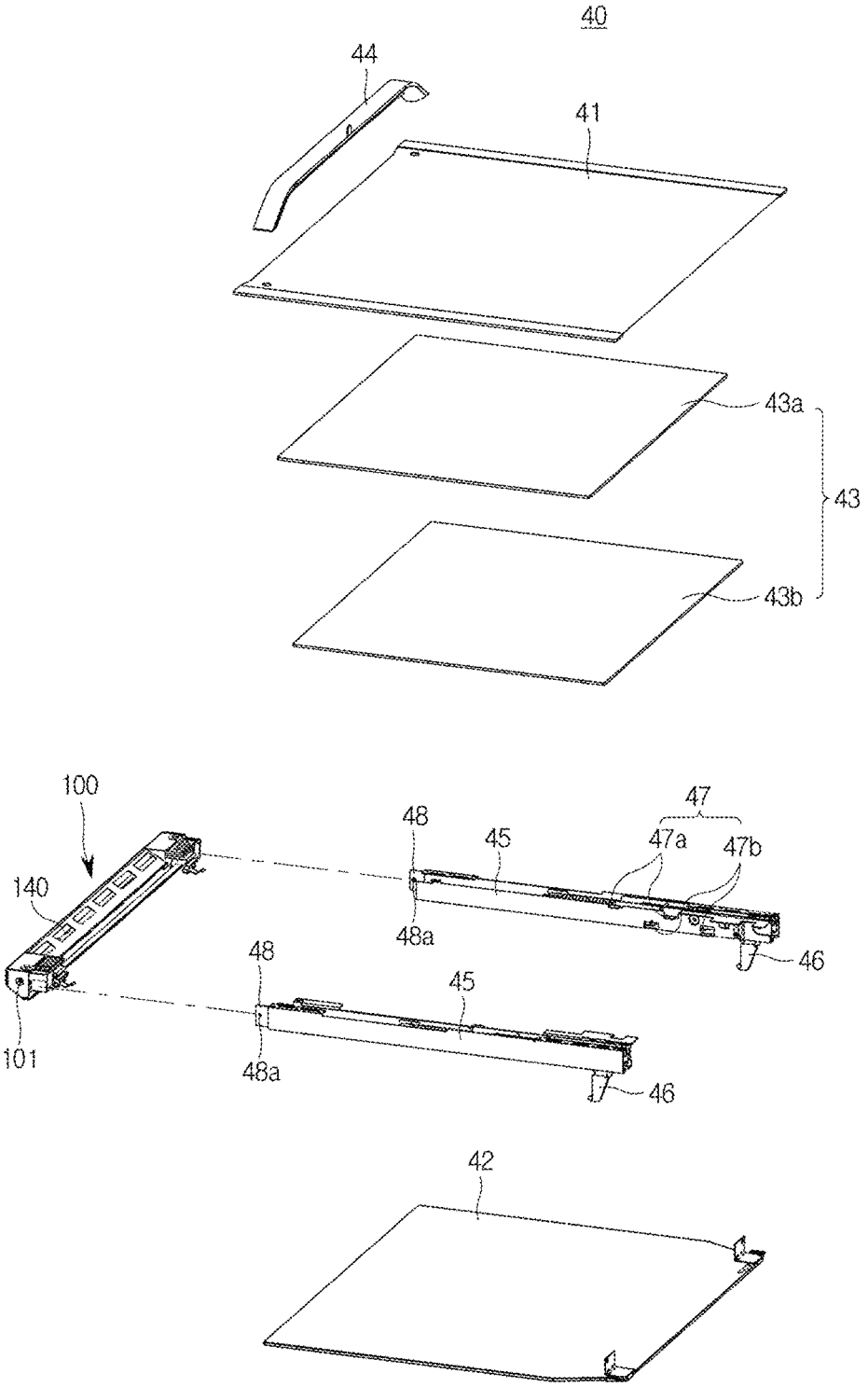
FIG. 5 is an exploded perspective view of a door, according to an embodiment of the present disclosure.

As shown in FIGS. 4 and 5, the door 40 includes a front glass 41 installed on the front, a rear glass 42 installed behind the front glass 41 to seal up the cooking room 20, a plurality of middle glasses 43 provided between the front glass 41 and the rear glass 42 with the height lower than the front glass 41, a door handle 44 coupled to an upper front portion of the front glass 41 for the user to grab it, support frames 45 provided on both sides of the door 40 to fix the front glass 41, rear glass 42, and middle glasses 43 (see FIG. 1).

The middle glasses 43 may include a first middle glass 43*a* placed behind the front glass 41 to be adjacent to the front glass 41 and a second middle glass 43*b* placed between the first middle glass 43*a* and the rear glass 42.

In the figures, two of the middle glasses 43 are shown, but there may be a single middle glass 43 or two or more middle glasses 43.

The front glass 41, the rear glass 42, and the middle glass 43 may be fixed by the support frames 45 arranged on both sides of the door 40, in which case the front glass 41 and the rear glass 42 are coupled with the front side and the rear side, respectively, of the support frames 45, and the middle glass 43 is fixed by a plurality of support ribs 47 arranged on the support frames 45 not to be moved.

The support ribs 47 includes a first support rib 47*a* to support the first middle glass 43*a* and a second support rib 47*b* to support the second middle glass 43*b*.

Figure 6:
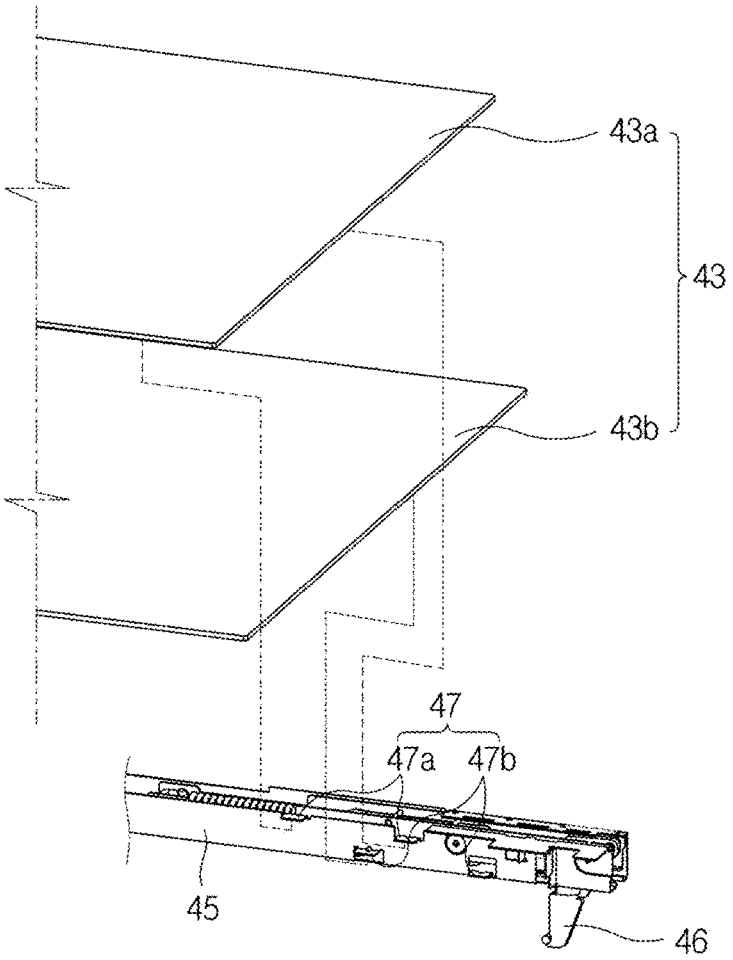
FIG. 6 shows middle glasses to be supported by a support frame, according to an embodiment of the present disclosure.
Figure 7:
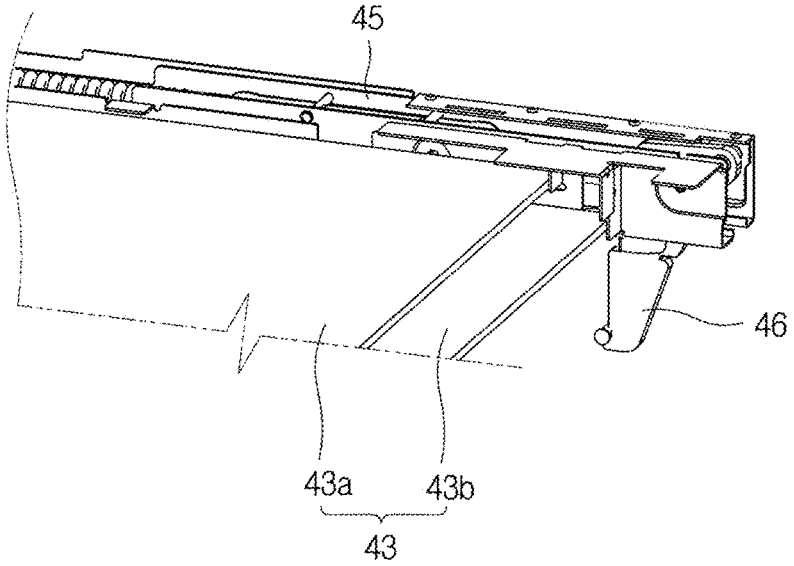
FIG. 7 shows middle glasses supported by a support frame, according to an embodiment of the present disclosure.

As shown in FIGS. 5 to 7, the support frame 45 may have a hinge member 46 for the door 40 to be pivotally coupled with the main body 10, the plurality of support ribs 47 to support the plurality of middle glasses 43 not to be moved, and a coupler 48 to which a door duct 100, which will be described later, is coupled.

The coupler 48 has a second coupling hole 48*a* corresponding to a first coupling hole 101 of the door duct 100 to be coupled to the coupler 48, enabling the door duct 100 to be coupled to the coupler 48 by a fastening member (not shown).

Figure 10:
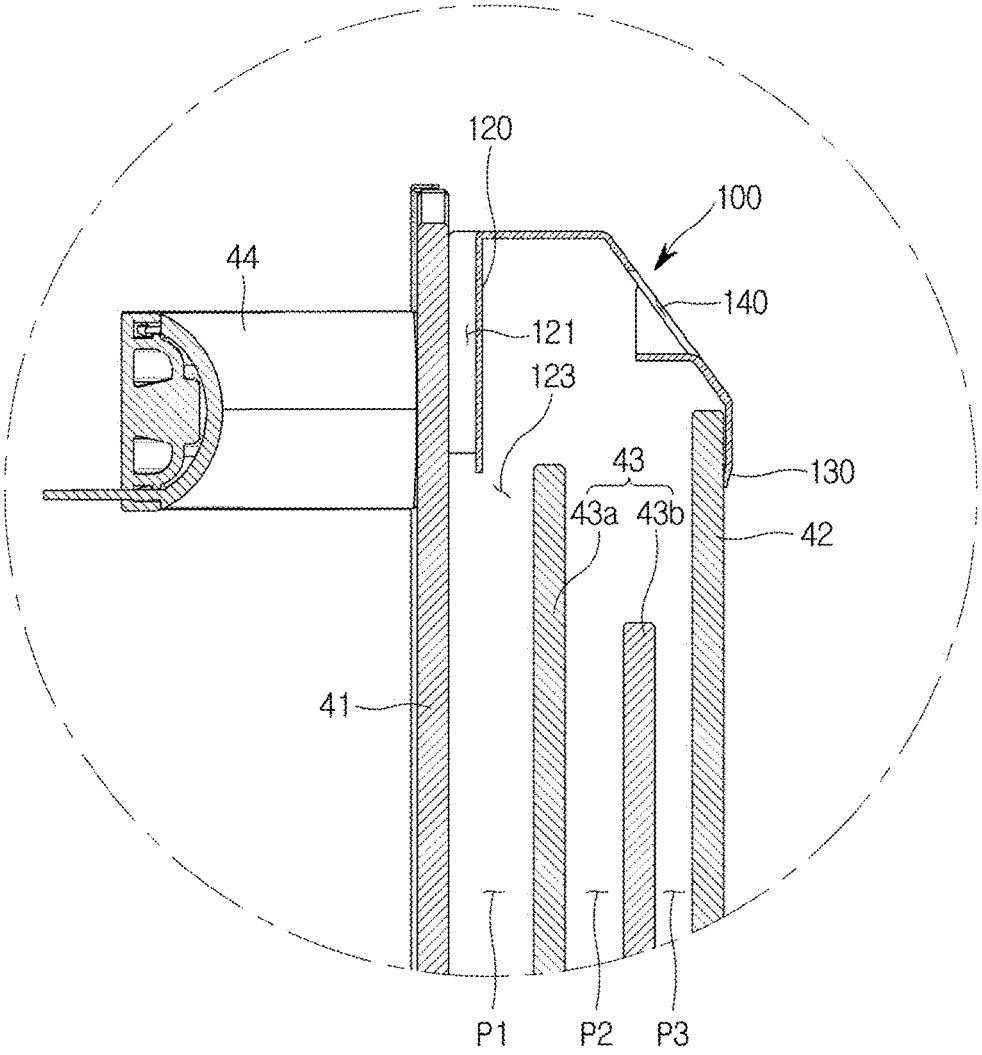
FIG. 10 is a side cross-sectional view of an upper portion of a door, according to an embodiment of the present disclosure.

The door 40 is comprised of a plurality of glasses including the front glass 41, the middle glass 43, and the rear glass 42 to prevent heat inside the cooking room 20 from leaking out, and air flow paths P1, P2, P3 are formed in between the front glass 41, the middle glasses 43, and the rear glass 42 (see FIG. 10).

The temperature of the door 40 rises due to heat inside the cooking room 20, and to prevent the temperature rise of the door 40, a sucking port 49 to suck in outside air is provided in a lower portion of the door 40, in which case the air sucked in through the sucking port 49 circulates in the air paths P1, P2, P3 to reduce the temperature of the door 40 and is discharged to the outside (see FIGS. 3 and 10).

The door duct 100 is coupled to an upper portion of the support frame 45 for guiding the air flow path P1 between the front glass 41 and the middle glass 43 to extend to an upper portion of the front glass 41 (see FIG. 10).

Figure 8:
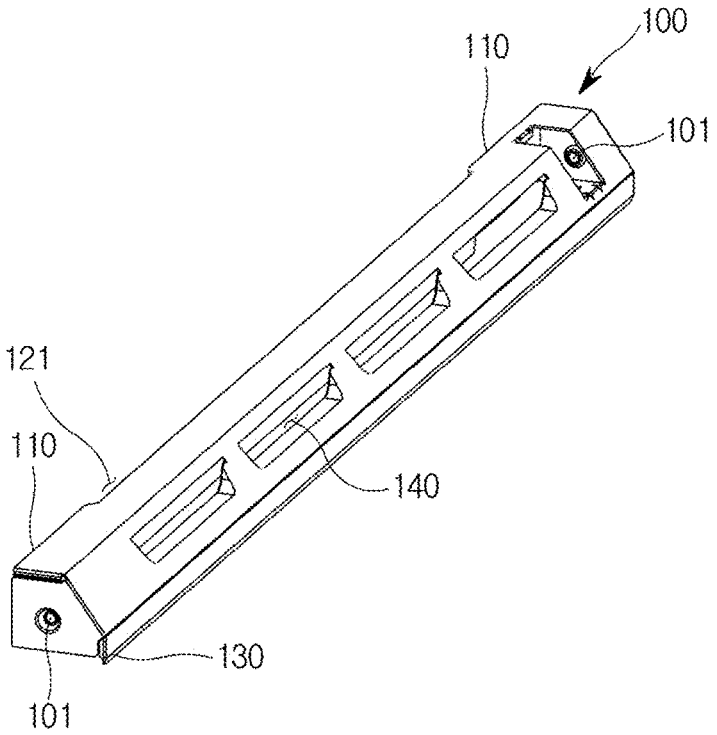
FIG. 8 is a perspective view of a door duct, according to an embodiment of the present disclosure.
Figure 9:
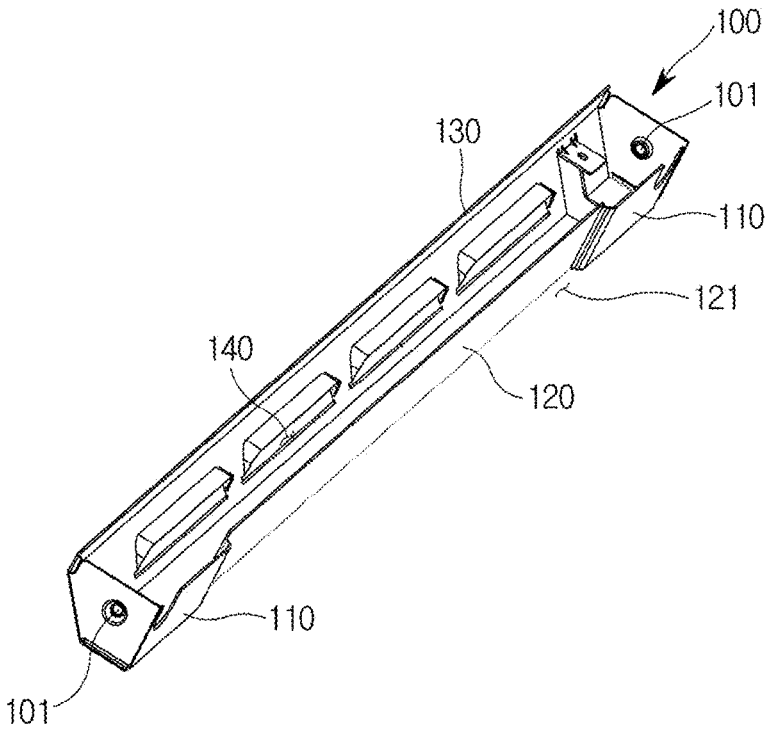
FIG. 9 is a perspective view of the door duct shown in FIG. 8, which is viewed from another angle.

As shown in FIGS. 8 to 10, the door duct 100 may include a first contact portion 110 which is in close contact with an upper portion of the rear side of the front glass 41, a guide 120 forming a guide path 121 to guide the first air flow path P1 between the guide path 121 and the front glass 41 to extend to an upper portion of the front glass 41, a second contact portion 130 which is in close contact with an upper portion of the rear side of the rear glass 42, and a plurality of discharging holes 140 through which the air inside the door 40 is discharged out of the door 40 in a direction toward the cooking room 20.

When the door duct 100 is coupled to an upper portion of the support frame 45, the first contact portion 110 comes into close contact with an upper portion of the rear side of the front glass 41 and the second contact portion 130 comes into close contact with an upper portion of the rear side of the rear glass 42, so that upper portions of the air flow paths P1, P2, P3 formed by the front glass 41, the middle glass 43, and the rear glass 42 are sealed.

The first contact portions 110 are provided on both sides of the door duct 100, and the guide 120 is provided between the first contact portions 110 provided on both sides of the door duct 100 to protrude from the first contact portions 110 toward the rear glass 42.

Since the guide 120 is provided to be separated from the rear side of the front glass 41, the upper portion of the guide path 121 formed by the guide 120 is not sealed but opened.

The guide 120 protrudes from the first contact portions 110 to have a smaller gap than the gap between the front glass 41 and the first middle glass 43*a*, and is thus arranged between the front glass 41 and the first middle glass 43*a*.

Accordingly, some of the air flowing in the first air flow path P1 moves to an upper portion of the front glass 41 along the guide path 121 and is discharged out of the door 40 through the open top of the guide path 121.

Some of the rest of the air flowing in the first air flow path P1 is discharged out of the first air flow path P1 through a space 123 between the guide 120 and the first middle glass 43*a*.

The air discharged out of the first air flow path P1 through the space 123 between the guide 120 and the first middle glass 43*a* is discharged out of the door 40 through the plurality of discharging holes 140 along with the air flowing in the second air flow path P2 and the third air flow path P3.

The air flowing in the second air flow path P2 and the third air flow path P3 is not moved toward the first air flow path P1 due to the air discharged out of the first air flow path P1 through the space 123 between the guide 120 and the first middle glass 43*a* but discharged through the discharging hole 140 along with the air discharged out of the first air flow path P1 through the space 123 between the guide 120 and the first middle glass 43*a*.

Since the first air flow path P1 is farthest from the cooking room 20, the air flowing in the first air flow path P1 is maintained at a relatively low temperature as compared with the air flowing in the second air flow path P2 and the third air flow path P3.

Since the air flowing in the first air flow path P1, which is maintained at the relatively low temperature, reaches to an upper portion of the front glass 41 through the guide path 121 without being mixed with the air flowing in the second air flow path P2 and the third air flow path P3, the upper portion of the front glass 41 may remain at a low temperature and when the user grabs the door handle 44 coupled to the upper front portion of the front glass 41, the user may grab the door handle 44 to open or close the door 40 without feeling hot because the upper front portion of the front glass 41 remains at a relatively low temperature.

Next, referring to FIGS. 11 to 19, other embodiments of a door duct will be described.

Coupling holes 201, 301, 401 of door ducts 200, 300, 400 shown in FIGS. 11 to 19 are the same as the coupling hole 101 of the door duct 100 as shown in FIGS. 8 to 10, so the description thereof will be omitted below.

Figure 11:
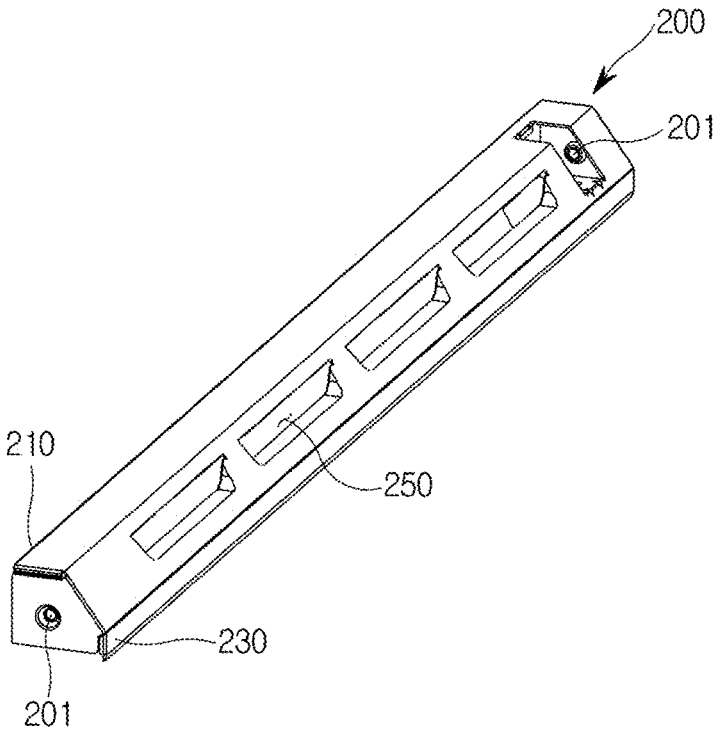
FIG. 11 is a perspective view of a door duct, according to another embodiment of the present disclosure.
Figure 12:
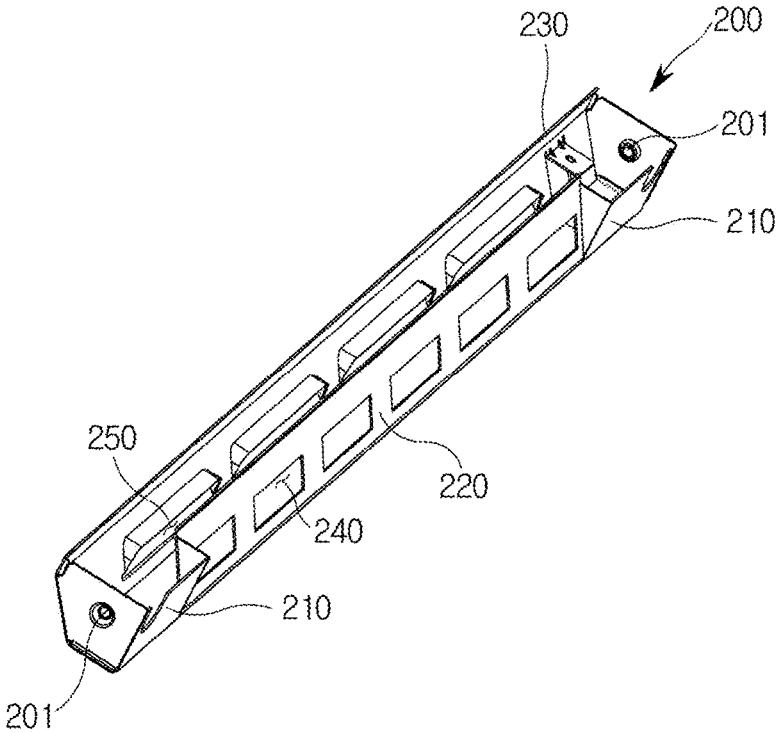
FIG. 12 is a perspective view of the door duct shown in FIG. 11, which is viewed from another angle.
Figure 13:
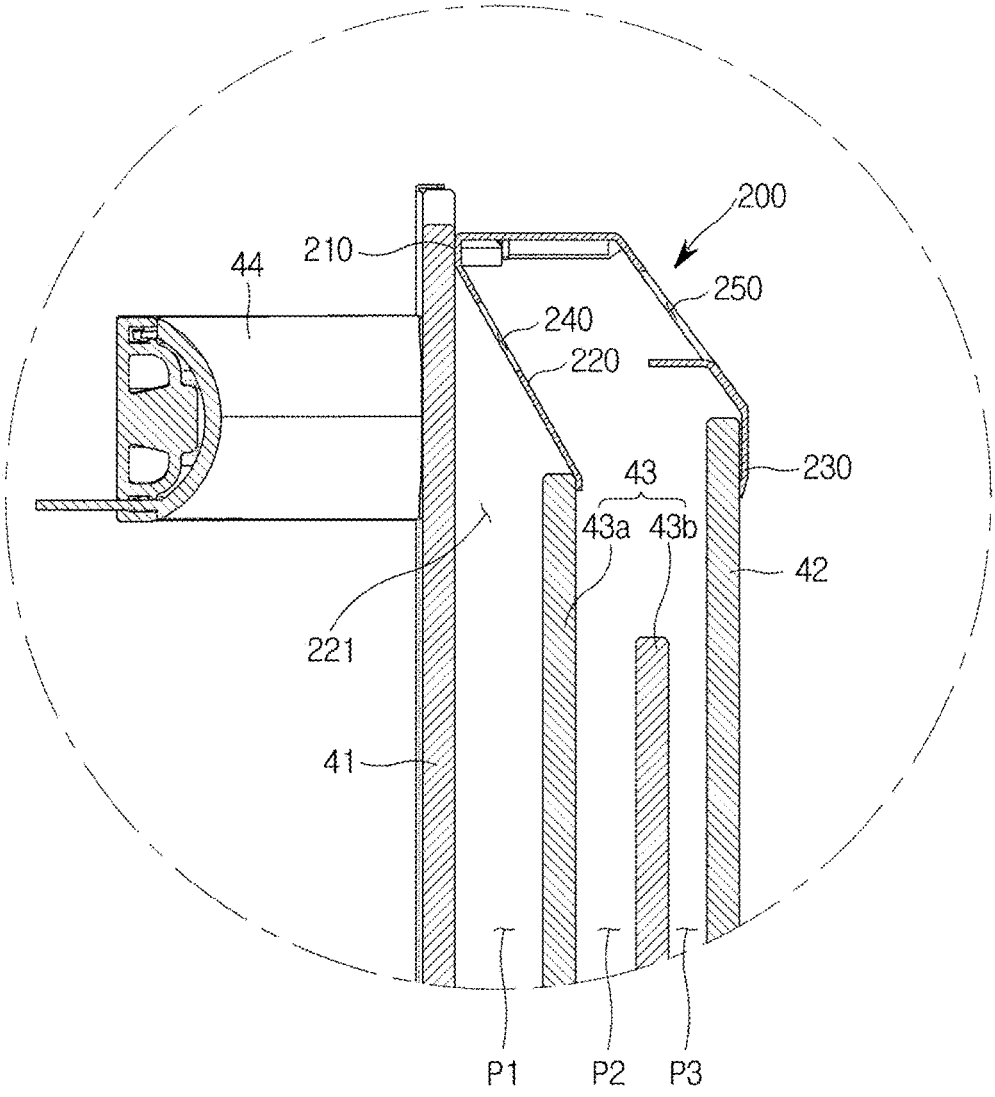
FIG. 13 is a side cross-sectional view of an upper portion of a door, according to another embodiment of the present disclosure.

As shown in FIGS. 11 to 13, the door duct 200 may include a first contact portion 210 which is in close contact with an upper portion of the rear side of the front glass 41, a guide 220 forming a guide path 221 to guide the first air flow path P1 between the guide path 221 and the front glass 41 to extend to an upper portion of the front glass 41, a second contact portion 230 which is in close contact with an upper portion of the rear side of the rear glass 42, a plurality of first discharging holes 240 formed on the guide 220 through which the air of the guide path 221 is discharged out of the guide path 221, and a plurality of second discharging holes 250 through which the air inside the door 40 is discharged out of the door 40 in a direction toward the cooking room 20.

When the door duct 200 is coupled to an upper portion of the support frame 45, the first contact portion 210 comes into close contact with an upper portion of the rear side of the front glass 41 and the second contact portion 230 comes into close contact with an upper portion of the rear side of the rear glass 42, so that upper portions of the air flow paths P1, P2, P3 formed by the front glass 41, the middle glass 43, and the rear glass 42 are sealed.

The first contact portion 210 is formed all across the front side of the door duct 200 so that a gap between the front side of the door duct 200 and the rear side of the front glass 41 is completely sealed.

One side of the guide 220 is in close contact with an upper portion of the rear side of the first middle glass 43*a* while the other side is coupled to the first contact portion 210, to seal up the first air flow path P1.

The guide 220 links the upper portion of the rear side of the first middle glass 43*a* and the first contact portion 210 which is in close contact with the upper portion of the rear side of the front glass 41, so that the guide 220 has a form inclined upward from the first middle glass 43*a* to the front glass 41 and thus the air flowing in the first air flow path P1 reaches to the upper portion of the front glass 41 through the guide path 221.

The air flowing in the first air flow path P1 passes the guide path 221 and is discharged out of the guide path 221 through the first discharging holes 240 formed on the guide 220.

The air discharged out of the first discharging holes 240 is discharged out of the door 40 through the second discharging holes 250 along with the air flowing in the second air flow path P2 and the third air flow path P3.

The air flowing in the second air flow path P2 and the third air flow path P3 is not moved toward the first air flow path P1 due to the air discharged through the first discharging holes 240 but discharged through the second discharging holes 250 along with the air being discharged through the first discharging holes 240.

Since the first air flow path P1 is farthest from the cooking room 20, the air flowing in the first air flow path P1 is maintained at a relatively low temperature as compared with the air flowing in the second air flow path P2 and the third air flow path P3.

Since the air flowing in the first air flow path P1, which is maintained at the relatively low temperature, reaches to an upper portion of the front glass 41 through the guide path 221 without being mixed with the air flowing in the second air flow path P2 and the third air flow path P3, the upper portion of the front glass 41 may remain at a low temperature and when the user grabs the door handle 44 coupled to the upper front portion of the front glass 41, the user may grab the door handle 44 to open or close the door 40 without feeling hot because the upper front portion of the front glass 41 remains at a relatively low temperature.

Figure 14:
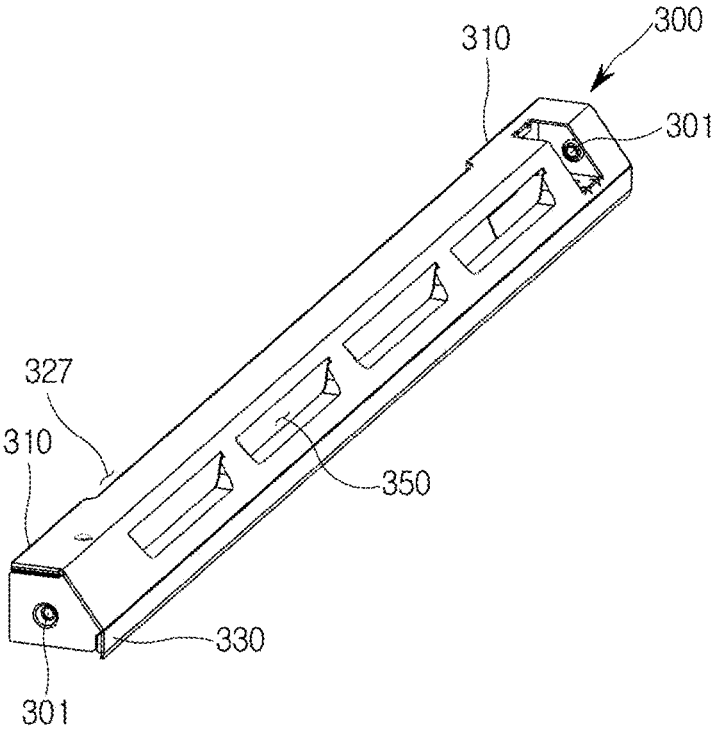
FIG. 14 is a perspective view of a door duct, according to another embodiment of the present disclosure.
Figure 15:
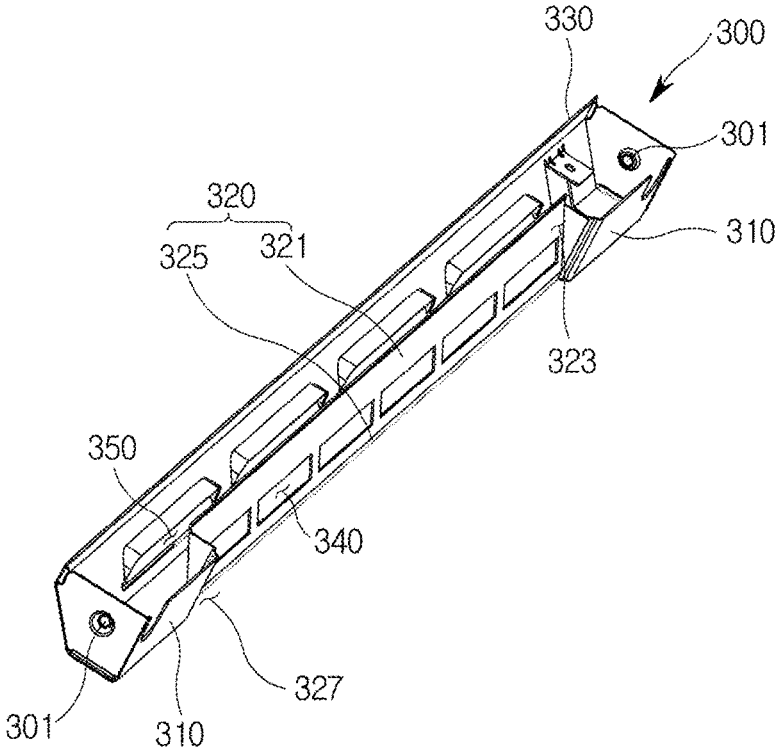
FIG. 15 is a perspective view of the door duct shown in FIG. 14, which is viewed from another angle.
Figure 16:
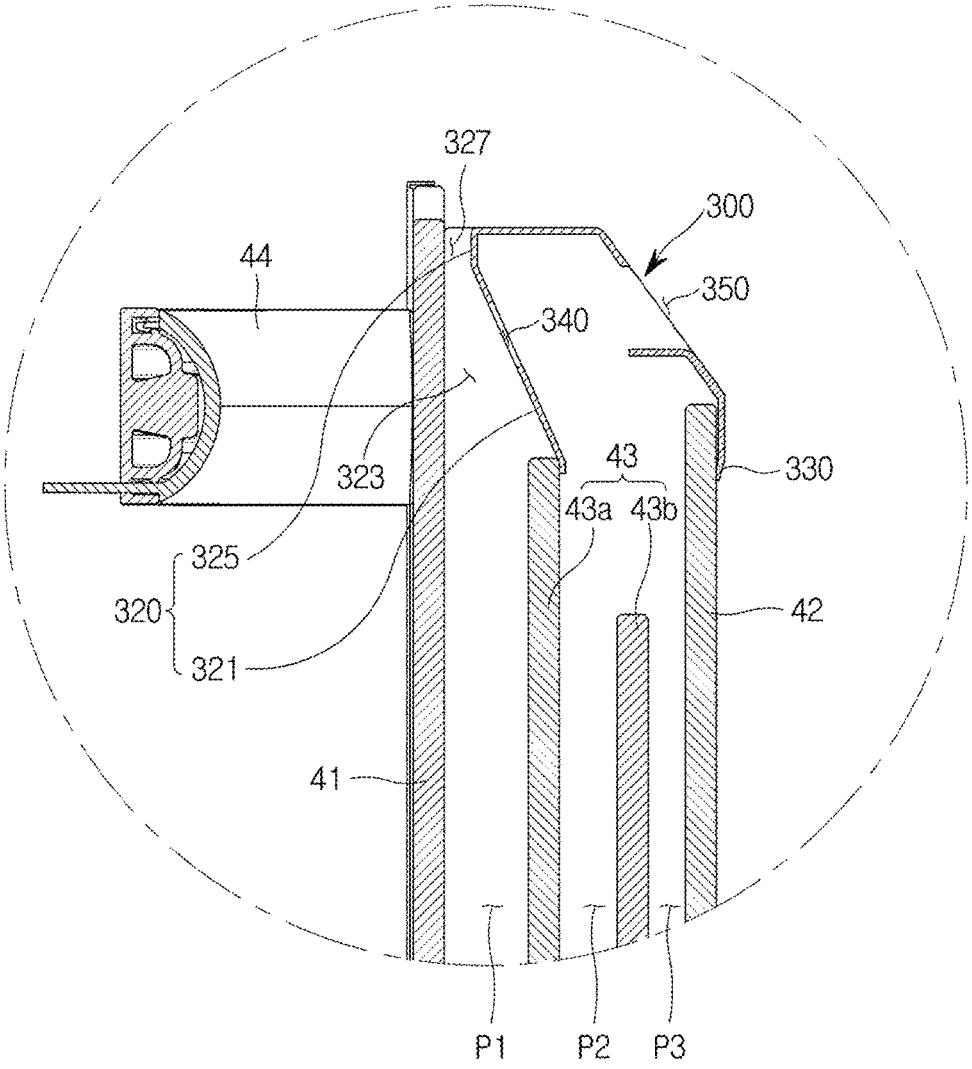
FIG. 16 is a side cross-sectional view of an upper portion of a door, according to another embodiment of the present disclosure.

As shown in FIGS. 14 to 16, the door duct 300 may include a first contact portion 310 which is in close contact with an upper portion of the rear side of the front glass 41, a guide 320 forming a guide path 327 to guide the first air flow path P1 between the guide path 323, 327 and the front glass 41 to extend to an upper portion of the front glass 41, a second contact portion 330 which is in close contact with an upper portion of the rear side of the rear glass 42, a plurality of first discharging holes 340 formed on the guide 320 through which the air of the guide path 323 is discharged out of the guide path 323, and a plurality of second discharging holes 350 through which the air inside the door 40 is discharged out of the door 40 in a direction toward the cooking room 20.

When the door duct 300 is coupled to an upper portion of the support frame 45, the first contact portion 310 comes into close contact with an upper portion of the rear side of the front glass 41 and the second contact portion 330 comes into close contact with an upper portion of the rear side of the rear glass 42, so that upper portions of the air flow paths P1, P2, P3 formed by the front glass 41, the middle glass 43, and the rear glass 42 are sealed.

The first contact portions 310 are provided on both sides of the door duct 300, and the guide 320 is provided between the first contact portions 310 on both sides of the door duct 300.

The guide 320 includes a first guide 321 forming a first guide path 323 to guide the first air flow path P1 between it and the front glass 41 to extend upward, and a second guide 325 forming a second guide path 327 to guide the first guide path 323 between it and the front glass 41 to extend to an upper portion of the front glass 41.

The second guide 325 is provided to protrude in a direction from the first contact portion 310 toward the rear glass 42.

Since the second guide 325 is provided to be separated from the rear side of the front glass 41, the top of the second guide path 327 formed by the second guide 325 is not sealed but opened.

The second guide 325 protrudes from the first contact portions 310 to have a smaller gap than the gap between the front glass 41 and the first middle glass 43*a*, and is thus arranged between the front glass 41 and the first middle glass 43*a*.

One side of the first guide 321 is in close contact with an upper portion of the rear side of the first middle glass 43*a* and the other side is coupled to the second guide 325.

The first guide 321 links the upper portion of the rear side of the first middle glass 43*a* and second guide 325, so that the first guide 321 has a form inclined upward from the first middle glass 43*a* to the front glass 41 and thus the air flowing in the first air flow path P1 reaches to the second guide path 327 through the first guide path 323.

Some of the air that reaches the first guide path 323 is discharged out of the first guide path 323 through the first discharging holes 340, and some of the rest reach the second guide path 327 and are discharged out of the door 40 through the open top of the second guide path 327.

The air discharged out of the first discharging holes 340 is discharged out of the door 40 through the second discharging holes 350 along with the air flowing in the second air flow path P2 and the third air flow path P3.

The air flowing in the second air flow path P2 and the third air flow path P3 is not moved toward the first air flow path P1 due to the air discharged through the first discharging holes 340 but discharged through the second discharging holes 350 along with the air being discharged through the first discharging holes 340.

Since the first air flow path P1 is farthest from the cooking room 20, the air flowing in the first air flow path P1 is maintained at a relatively low temperature as compared with the air flowing in the second air flow path P2 and the third air flow path P3.

Since the air flowing in the first air flow path P1, which is maintained at the relatively low temperature, reaches to an upper portion of the front glass 41 through the guide path 320 without being mixed with the air flowing in the second air flow path P2 and the third air flow path P3, the upper portion of the front glass 41 may remain at a low temperature and when the user grabs the door handle 44 coupled to the upper front portion of the front glass 41, the user may grab the door handle 44 to open or close the door 40 without feeling hot because the upper front portion of the front glass 41 remains at a relatively low temperature.

Figure 17:
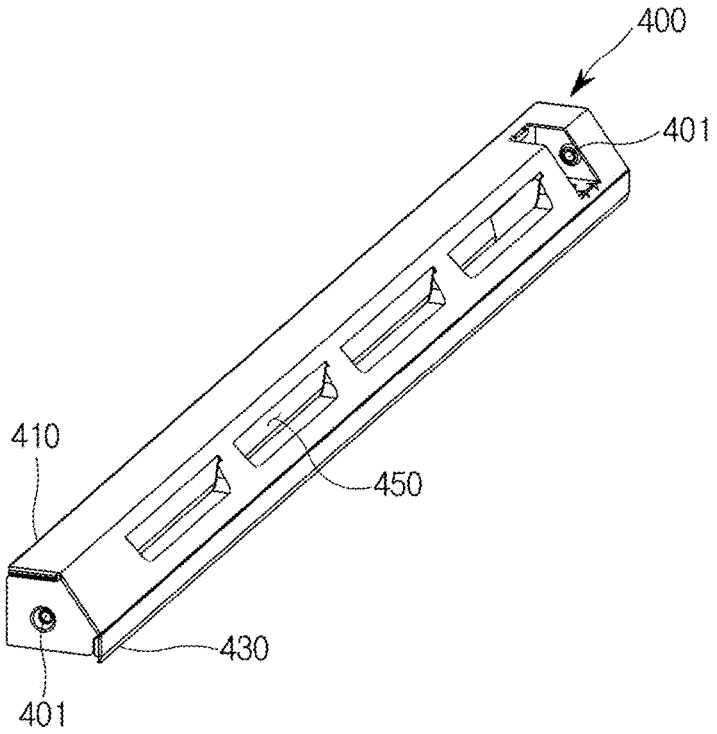
FIG. 17 is a perspective view of a door duct, according to another embodiment of the present disclosure.
Figure 18:
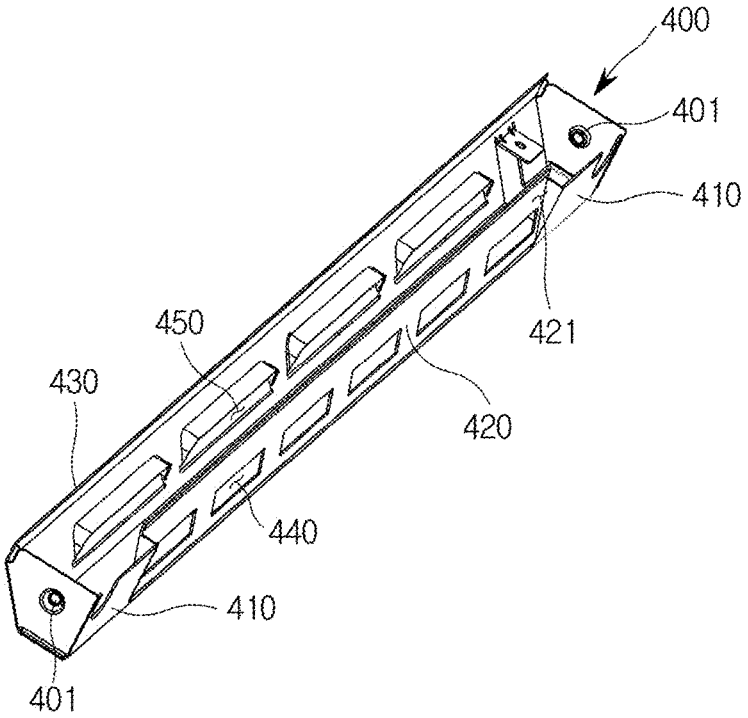
FIG. 18 is a perspective view of the door duct shown in FIG. 17, which is viewed from another angle.
Figure 19:
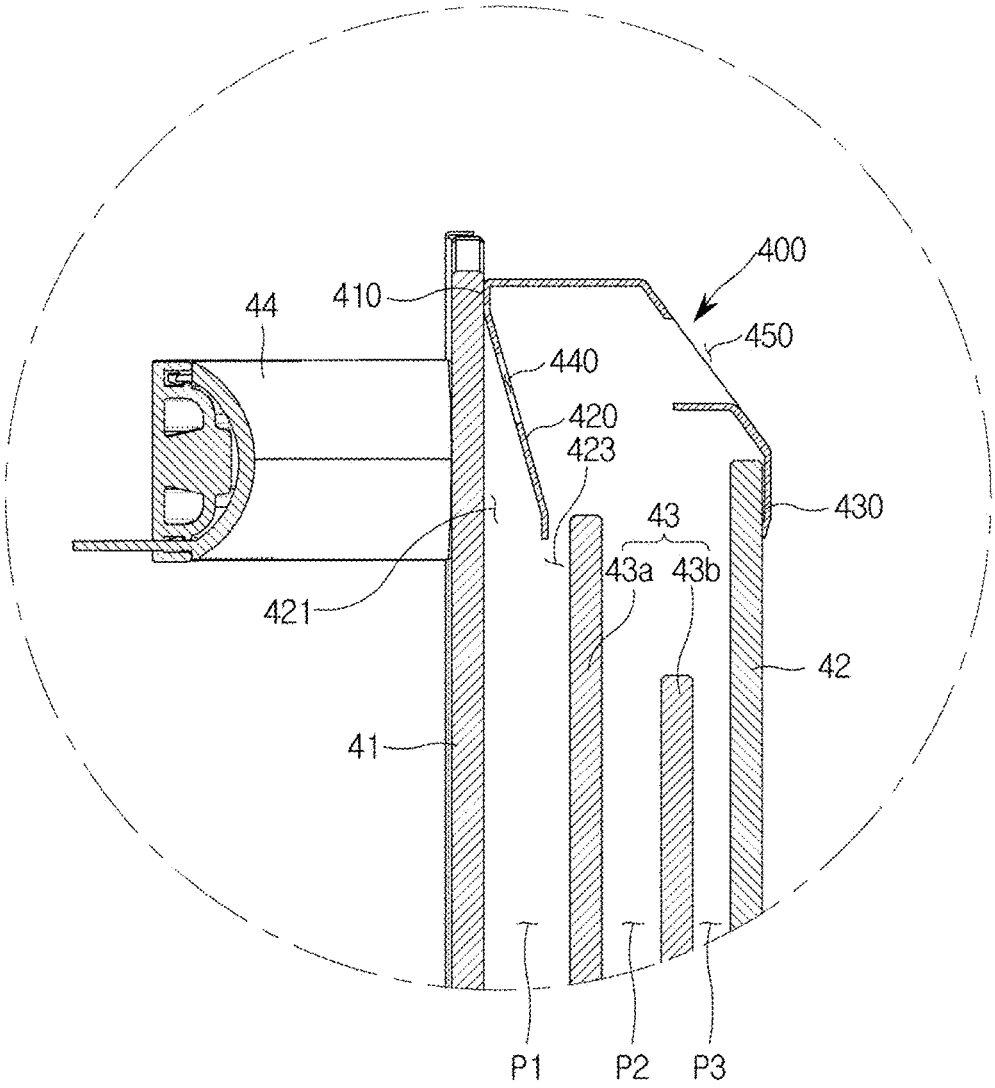
FIG. 19 is a side cross-sectional view of an upper portion of a door, according to another embodiment of the present disclosure.

As shown in FIGS. 17 to 19, the door duct 400 may include a first contact portion 410 which is in close contact with an upper portion of the rear side of the front glass 41, a guide 420 forming a guide path 421 to guide the first air flow path P1 between the guide path 421 and the front glass 41 to extend to an upper portion of the front glass 41, a second contact portion 430 which is in close contact with an upper portion of the rear side of the rear glass 42, a plurality of first discharging holes 440 formed on the guide 420 through which the air of the guide path 421 is discharged out of the guide path 421, and a plurality of second discharging holes 450 through which the air inside the door 40 is discharged out of the door 40 in a direction toward the cooking room 20.

When the door duct 400 is coupled to an upper portion of the support frame 45, the first contact portion 410 comes into close contact with an upper portion of the rear side of the front glass 41 and the second contact portion 430 comes into close contact with an upper portion of the rear side of the rear glass 42, so that upper portions of the air flow paths P1, P2, P3 formed by the front glass 41, the middle glass 43, and the rear glass 42 are sealed.

The first contact portion 410 is formed all across the front side of the door duct 400 so that a gap between the front side of the door duct 400 and the rear side of the front glass 41 is completely sealed.

The guide 420 is provided to extend from the first contact portion 410 to the space between the front glass 41 and the first middle glass 43*a*, so that the guide 420 is arranged between the front glass 41 and the first middle glass 43*a*.

Accordingly, some of the air flowing in the first air flow path P1 pass the guide path 421 and is discharged out of the guide path 421 through the first discharging holes 440, and some of the rest of the air flowing in the first flow path P1 is discharged through the space 423 between the guide 420 and the first middle glass 43*a*.

The air discharged through the first discharging holes 440 and the air discharged through the space 423 between the guide 420 and the first middle glass 43*a* is discharged out of the door 40 through the second discharging holes 450 along with the air flowing in the second air flow path P2 and the third air flow path P3.

The air flowing in the second air flow path P2 and the third air flow path P3 is not moved toward the first air flow path P1 due to the air discharged through the first discharging holes 440 and the air discharged through the space 423 between the guide 420 and the first middle glass 43*a*, but discharged through the second discharging holes 450 along with the air discharged through the first discharging holes 440 and the air discharged through the space 423 between the guide 420 and the first middle glass 43*a*.

Since the first air flow path P1 is farthest from the cooking room 20, the air flowing in the first air flow path P1 is maintained at a relatively low temperature as compared with the air flowing in the second air flow path P2 and the third air flow path P3.

Since the air flowing in the first air flow path P1, which is maintained at the relatively low temperature, is not mixed with the air flowing in the second air flow path P2 and the third air flow path P3 and reaches to an upper portion of the front glass 41 through the guide path 421, the upper portion of the front glass 41 may be able to remain at a low temperature and when the user grabs the door handle 44 coupled to the upper front portion of the front glass 41, the user may grab the door handle 44 to open or close the door 40 without feeling hot because the upper front portion of the front glass 41 remains at a relatively low temperature.

Several embodiments have been described but a person of ordinary skill in the art will understand and appreciate that various modifications can be made without departing from the scope of the present disclosure. Thus, it will be apparent to those of ordinary skill in the art that the disclosure is not limited to the embodiments described, which have been provided only for illustrative purposes. Although the present disclosure has been described with an exemplary embodiment, various changes and modifications may be suggested to one skilled in the art. It is intended that the present disclosure encompass such changes and modifications as fall within the scope of the appended claims.

The invention claimed is:

1. An oven comprising:

a main body;

a cooking room provided inside the main body with an open front;

a door provided to open or close the cooking room, wherein the door comprises:

a front glass installed on a front side;

a rear glass installed on a rear side;

at least one middle glass arranged between the front glass and the rear glass to form a plurality of air flow paths;

a door handle coupled to an upper portion of the front glass;

support frames arranged on both sides of the door to fix the front glass, the rear glass, and the middle glass; and a door duct coupled to an upper portion of each of the support frames for guiding an air flow path between the front glass and the middle glass to extend to an upper portion of the front glass, wherein the door duct comprises a guide forming a guide path to guide a first air flow path to extend to an upper portion of the front glass, and a plurality of discharging holes through which air inside the door is discharged out of the door in a direction toward the cooking room.

2. The oven of claim 1, wherein the middle glass comprises a first middle glass arranged adjacent to a rear side of the front glass and a second middle glass arranged between the first middle glass and the rear glass.

3. The oven of claim 2, wherein the plurality of air flow paths comprises a first air flow path formed between the front glass and the first middle glass, a second air flow path formed between the first middle glass and the second middle glass, and a third air flow path formed between the second middle glass and the rear glass.

4. The oven of claim 3, wherein each of the support frames includes a plurality of support ribs to support the middle glass not to be moved, a coupler coupled with the door duct, and a hinge member to pivotally couple the door with the main body.

5. The oven of claim 4, wherein the door duct includes a first coupling hole to be coupled with the coupler, and the coupler has a second coupling hole corresponding to the first coupling hole.

6. The oven of claim 5, wherein the door duct further comprises a first contact portion in contact with an upper portion of the rear side of the front glass, and second contact portion that is in close contact with an upper portion of the rear side of the rear glass.

7. The oven of claim 6, wherein a top of the guide path is opened, and the guide is arranged between the front glass and the first middle glass to force some of the air flowing in the first air flow path to be discharged out of the door through the guide path and some of the rest of the air flowing in the first air flow path to be discharged out of the first air flow path through a space between the guide and the first middle glass.

8. The oven of claim 7, wherein the air discharged through the space between the guide and the first middle glass is discharged out of the door through plurality of discharging holes along with the air flowing in the second air flow path and the third air flow path.

9. The oven of claim 5, wherein the door duct further comprises a first contact portion in contact with an upper portion of the rear side of the front glass, and a second contact portion in contact with an upper portion of the rear side of the rear glass.

10. The oven of claim 9, wherein one side of the guide is in contact with an upper portion of a rear side of the first middle glass and another side is coupled to the first contact portion, forcing the air flowing in the first air flow path to pass the guide and be discharged to the outside through a plurality of first discharging holes and forcing the air flowing in the second air flow path and the third air flow path to be discharged out of the door through a plurality of second discharging holes.

11. The oven of claim 10, wherein the guide comprises a first guide forming a first guide path between the guide and the front glass to guide the first air flow path to extend upward, and a second guide forming a second guide path between the guide and front glass to guide the first guide path to extend to an upper portion of the front glass.

12. The oven of claim 11, wherein the second guide protrudes from a first contact portion toward the rear glass to open a top of the second guide path while arranged between the front glass and the first middle glass, and one side of the first guide is in contact with an upper portion of the rear side of the first middle glass and another side is coupled to the second guide, and the plurality of first discharging holes are formed on the first guide.

13. The oven of claim 12, wherein air flowing in the first air flow path reaches the first guide path.

14. The oven of claim 9, wherein the guide is arranged between the front glass and the first middle glass to force some of the air flowing in the first air flow path to pass the guide path.

15. The oven of claim 14, wherein the air discharged out of the guide path through a plurality of first discharging holes and the air discharged through a space between the guide and the first middle glass is discharged out of the door through a plurality of second discharging holes along with the air flowing in the second air flow path and the third air flow path.

16. The oven of claim 9, wherein the door duct further comprises a plurality of first discharging holes, through which air is discharged out of the guide path, and a plurality of second discharging holes through which air is discharged out of the door in a direction toward the cooking room.

17. The oven of claim 13, wherein a portion of the air flowing in the first air flow path is discharged out of the door through the second guide path.

18. The oven of claim 13, wherein a portion of the air flowing in the first air flow path is discharged out of the first guide path through the plurality of first discharging holes or discharged out of the door through the plurality of second discharging holes along with the air flowing in the second air flow path and the third air flow path.

19. The oven of claim 14, wherein a portion of the air flowing in the first air flow path is discharged out of the guide path through a plurality of first discharging holes.

20. The oven of claim 14, wherein a portion of the air flowing in the first air flow path is discharged through a space between the guide and the first middle glass.

* * * * *